US007392619B2

(12) United States Patent
Pantke et al.

(10) Patent No.: US 7,392,619 B2
(45) Date of Patent: Jul. 1, 2008

(54) METHOD FOR CONTROLLING THE MOVEMENT OF A WINDOW OF A SIDE DOOR OF A MOTOR VEHICLE

(75) Inventors: Reinhard Pantke, Bad Liebenzell (DE); Markus Schwarz, Moeglingen (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 157 days.

(21) Appl. No.: 10/971,728

(22) Filed: Oct. 25, 2004

(65) Prior Publication Data

US 2005/0115154 A1 Jun. 2, 2005

(30) Foreign Application Priority Data

Oct. 25, 2003 (DE) ..... 103 49 912

(51) Int. Cl.
*E06B 3/00* (2006.01)

(52) U.S. Cl. ..... 49/506; 49/72; 49/31; 49/280

(58) Field of Classification Search ..... 49/72, 49/502, 31, 506, 279, 280; 296/146.2, 106, 296/201; 318/626, 266, 286, 466–468; 16/DIG. 6
See application file for complete search history.

(56) References Cited

U.S. PATENT DOCUMENTS 3,147,034 A * 9/1964 Maxey et al. ..... 49/73.1
5,495,693 A * 3/1996 Tiesler ..... 49/502
5,810,423 A * 9/1998 Brackmann et al. ..... 296/146.2
6,166,508 A 12/2000 Kalb

FOREIGN PATENT DOCUMENTS

| | | |
|---|---|---|
| DE | 41 07 271 | 9/1992 |
| DE | 42 03 512 | 5/1993 |
| DE | 195 47 582 | 6/1997 |
| EP | 0 917 674 | 5/2000 |

* cited by examiner

*Primary Examiner*—Gregory J. Strimbu
(74) *Attorney, Agent, or Firm*—Crowell & Moring LLP

(57) ABSTRACT

A method and apparatus for controlling the movement of a vehicle side window. The side window is movable by way of a window lifter, of a side door of a motor vehicle. The side window is automatically moved by the window lifter into a predetermined intermediate position as a function of a movement of the side door, the intermediate position deviating from a completely closed or lowered position of the side window. To prevent rattling noises due to the side window, starting from the completely lowered position of the side window, the side window is raised into the intermediate position at least when closing the side door. In this intermediate position, the side window with its upper window edge is moved in at least some sections into a sealing gap which is situated on a railing of the side door.

5 Claims, 1 Drawing Sheet

METHOD FOR CONTROLLING THE MOVEMENT OF A WINDOW OF A SIDE DOOR OF A MOTOR VEHICLE

BACKGROUND AND SUMMARY OF THE INVENTION

This applications claims the priority of German Application No. 103 49 912.1-23 filed Oct. 25, 2003, the disclosure of which is expressly incorporated by reference herein.

This invention starts with a method and apparatus for controlling the movement of a side window of a side door of a motor vehicle. Preferred embodiments of the invention relate to methods and apparatus for controlling the movement of a movable side window in a side door of a motor vehicle, said side window being movable by means of a window lifter operated by outside force, in which method the side window is moved automatically by the window lifter into a predetermined intermediate position as a function of a movement of the side door, said intermediate position differing from a completely closed or completely lowered position of the side window.

Such a method for controlling the movement of a side window of a side door of a motor vehicle is known; in this method, said side window is movable by means of an outside force-operated window lifter. In this method, the side window is automatically moved by the window lifter as a function of the movement of the side door from the closed position into the open position, such that the side window is moved into a predetermined intermediate position which deviates from a completely closed or lowered position of the side window. In the state of the art, this is described as a so-called short-stroke lowering. This starts from the completely closed position in which the window is completely raised, then the side window is lowered a few millimeters into the intermediate position when the side door is opened, so that the upper edge of the window is out of engagement with a gasket assigned to this edge of the window, so that opening of the door is facilitated and moreover less stress is put on the gasket. When the side door is again moved out of the open position into the closed position, the short-stroke lowering is canceled and the side window is again raised into the gasket so that the side window resumes the completely raised and closed position. This short-stroke lowering is known from European Patent Document EP 09 17 674 B1 (corresponding U.S. Pat. No. 6,166,508), German DE 41 07 271 A1, and German DE 195 47 582 C2 (corresponding U.S. Pat. No. 5,810,423), for example.

Another method for controlling the movement of a side window is known from German Patent DE 42 03 512 C1, wherein the side window is completely lowered when the side door is opened, so that entering the vehicle is facilitated in particular under tight parking conditions.

An object of certain preferred embodiments of this invention is to provide a method of the type referred to above for controlling the movement of a side window so as to optimize the quality impression given by the vehicle.

This object is achieved with a method for controlling the movement of a movable side window in a side door of a motor vehicle, said side window being movable by means of a window lifter operated by outside force, in which method the side window is moved automatically by the window lifter into a predetermined intermediate position as a function of a movement of the side door, said intermediate position differing from a completely closed or completely lowered position of the wide window, wherein, starting from a completely lowered position of the side window, the side window is raised into the intermediate position at least when the side door is closed, in which intermediate position the side window with its upper window edge is moved in at least some sections into a sealing gap situated on a railing of the side door.

Important advantages achieved with this invention can be regarded as the fact that the side window is supported laterally by the gasket with its upper window edge within the sealing gap in the movement of the side door from the open position to the closed position, so that rattling noises when closing the door are at least reduced. This method is used mainly with frameless side doors and in particular with convertibles which can be parked with the roof down. The side window is often left in its completely lowered position when the occupants leave the vehicle. The inventive method yields a high quality appearance when the side door is closed with the side window lowered because the side window does not cause any rattling noises.

According to an advantageous refinement of certain preferred embodiments of the invention wherein the side window is automatically moved back into the completely lowered position when the side door has again reached its closed position starting from its open position, when the closing of the side door is concluded, i.e., when the lock on the side door has been locked, the side window is completely lowered again into the intermediate position. This locking of the side door lock may be used as a parameter for controlling the window lifter, for example, so that on recognition that the lock is locked, the side window is automatically moved into the completely lowered position, in which it is completely lowered out of the sealing gap and thus is no longer visible.

In a preferred exemplary embodiment of the invention, wherein starting from the completely lowered position of the side window, the side window is automatically raised into the intermediate position when opening the side door, the side window is raised into the intermediate position when the side door is opened, i.e., when the lock is unlocked. Then the unlocking of the lock may be used as a parameter for controlling the window lifter. As an alternative exemplary embodiment, wherein manual operation of a door opening handle of the side door is determined and the side window is then automatically raised into the intermediate position, it is also conceivable for manual operation of the door opening handle by the vehicle user to be determined, whereupon the side window is automatically raised into the intermediate position. Then the operation of the internal door opening handle as well as the exterior door opening handle may be used for this.

According to certain preferred embodiments of this invention, the completely lowered position of the side window is determined. To do so, for example, a limit switch may be provided in the path of the side window. It would also be conceivable for the position of the window lifter which is operated by an outside force to be determined by means of its control device. Such methods of determining the current position of the side window or another movable car body part are known so they need not be described in detail here.

The invention also contemplates apparatus for carrying out the above described methods.

Other objects, advantages and novel features of the present invention will become apparent from the following detailed description of the invention when considered in conjunction with the accompanying drawings.

DETAILED DESCRIPTION OF THE DRAWINGS

Figure 1:
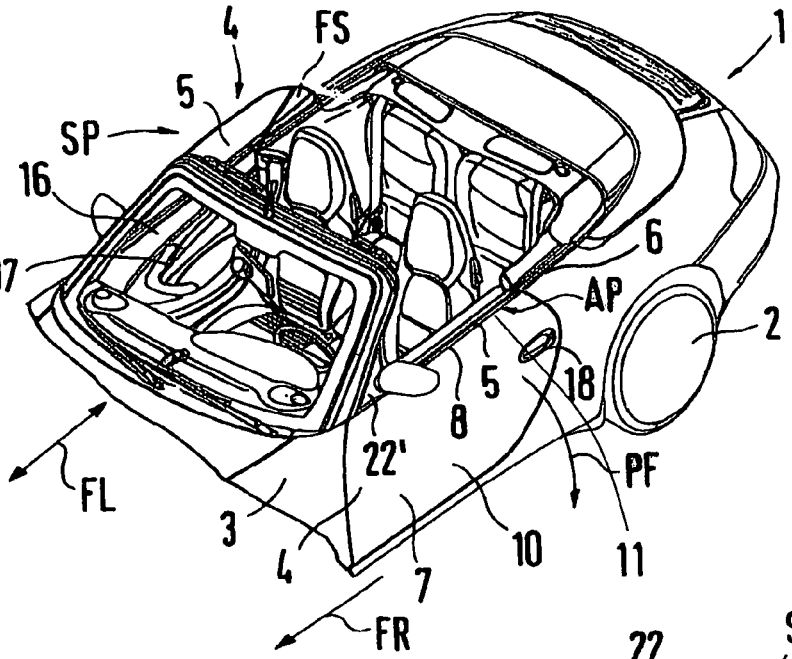
FIG. 1 is a perspective view of a motor vehicle with a side door and a side window, constructed according to preferred embodiments of the present invention.

Motor vehicle 1 shown partially in FIG. 1, namely here a passenger vehicle with a movable vehicle roof, has a body 3, which is supported by wheels 2 and has two or more side doors 4, which are equipped with a movable side window 5. With the side door 4 arranged on the left (as seen in the direction of travel FR), the side window 5 is shown in its completely lowered position AP. With the other side door 4 on the right, the side window 5 is shown in the completely raised and closed position SP. The lowered position AP and the closed position SP are end positions within the path (double arrow DP in FIG. 2) of the side window 5. The side window 5 mat be moved linearly and/or pivotably between these two end positions. As seen in the direction of travel FR, a movable rear window FS may also be provided on the body 3 behind each side window 5, with the left rear window being completely lowered and therefore not visible in the figure.

The side door 4 can be opened pivotably in the direction of the arrow PF into an open position (not shown here) and may be moved opposite the direction of the arrow PF back into the closed position SP shown in FIG. 1. The side door 4 is preferably designed without a frame i.e., no frame surrounding the side window 5 is provided above the belt line 6. A gasket strip that cooperates with the window 5 is thus mounted on the roof capping piece (not shown here) of the vehicle roof which has been lowered. This embodiment is also use with vehicles having a permanent roof.

Beneath the belt line 6 of the body 3, the side door 4 has a permanent door body 7 which has the door railing 8 in the belt line 6. In the area of the railing 8, an elongated opening 11 which extends in the longitudinal direction FL of the vehicle is provided as a slot for the side window 5 between the interior part 9 (FIG. 2) and the exterior part 10 of the door body 7 so that the side window can be moved into the window slot situated between the interior part 9 and the exterior part 10 and moved out of it again. A window gasket 12 (FIG. 3) is provided in the opening 11 and has, for example, two sealing lips 13 and 14 between which a sealing gap 15 is formed. The sealing lips 13 and 14 extend along the railing 8 within the opening 11, with the sealing lip 13 being assigned to the exterior part 10 and the sealing lip 14 being assigned to the interior part 9, for example, and being in contact with the side window 5 accordingly when the window protrudes into the sealing gap 15.

The two side doors 4 are shown in the closed position SP in FIG. 1 in which a lock 4' (FIG. 2) which is assigned to the side doors is locked. Door opening handles are provided on both the interior part 9 and the exterior part 10 for opening the side doors 4 and unlocking the lock 4'. The interior door opening handle 17 is provided on the interior part and/or on the door interior paneling 16 which covers the interior part, and controllers therefore and the exterior door opening handle 18 is provided on the exterior part 10.

Figure 2:
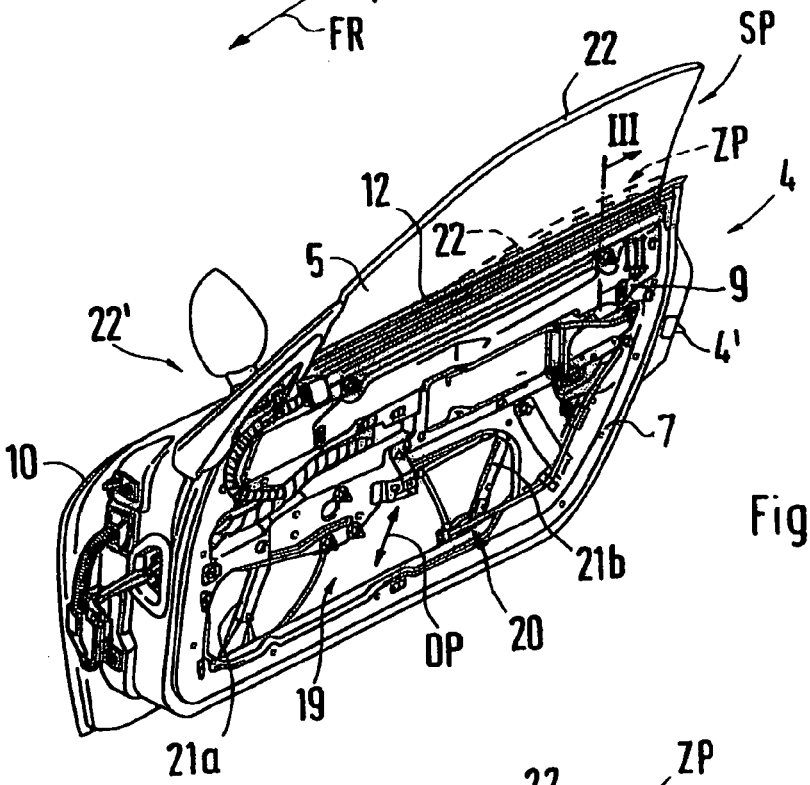
FIG. 2 is a view of the inside of the side door of FIG. 1, where the interior door paneling has been removed.

A window lifter 19 which is operated by outside force and of which only the operating parts 20 can be seen in FIG. 2, these parts being moved by a drive motor (not shown), said drive motor optionally being situated inside the door body 7 and triggered and controlled via a control device (not shown), is provided for moving the side window 5 between the completely raised closed position SP and the lowered position AP. For the guidance of the window 5 and its movement between the lowered position AP and the closed position SP and vice versa, guide rails having a U-shaped cross section, for example are provided, the front guide rail 21*a* and the rear guide rail 21*b* being shown in FIG. 2.

Figure 3:
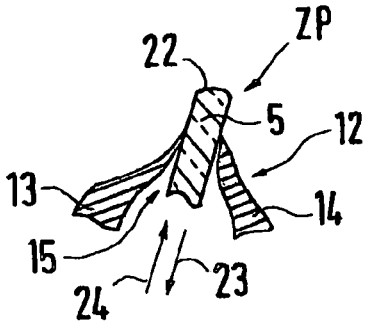
FIG. 3 shows a section through the door according to FIG. 2 along line III-III.

When the side door 4 is shifted from its closed position SP shown in FIG. 1 into the open position by moving it in the direction of the arrow PF, but after the lock 4' has first been unlocked, and when the side window 5 is in its completely lowered position AP within the door body 7, the side window 5 is shifted via the window lifter 19 into an intermediate position ZP illustrated in FIG. 2 and 3 when the side door 4 is moved out of the open position into the closed position SP opposite the direction of the arrow PF; in this intermediate position, the side window with its upper window edge 22 is raised until this window edge 22 comes to lie within the sealing gap 15 in at least some sections, so that the window 5 is laterally supported by the gasket 12, in particular by the two sealing lips 13 and 14. The window 5 is thus additionally supported laterally in the sealing gap 15 in the intermediate position ZP next to the guide rails 21, so that rattling noises due to the side window 5 are prevented when closing the side door 4. In the lowered position AP, the side window 5 is lowered to the extent that its upper window edge 22 cannot be seen within the sealing gap 15 and/or is shifted downward out the sealing gap 15.

FIG. 2 shows the intermediate position ZP of the side window 5 shown with a dashed line. It protrudes above the sealing gap 15 at least in some sections with its upper window edge 22 which runs in a curve and drops forward in the direction of the mirror triangle 22' in the direction of travel FR.

If the closing movement of the side door 4 opposite the direction of the arrow PF is ended, the side door 4 has assumed its closed position SP according to FIG. 1 and the lock 4' is locked, then the side window 5 may be moved automatically out of its intermediate position ZP and back into the completely lowered position AP, which the window 5 assumed before opening the door 4, by moving in the direction of the arrow 23. The locking of the lock 4' can be used as a parameter for canceling the intermediate position ZP. Raising (arrow 24 in FIG. 3) the window into the intermediate position ZP and lowering it into the lowered position AP thus take place as a function of the movement of the side door 4 and/or as a function of their current position and their direction of movement (in the direction of the arrow PF or in the opposite direction).

In order to be able to raise the side window 5 into the intermediate position ZP when opening the side door 4, the unlocking of the lock 4', for example, may be used as the starting parameter for controlling the movement of the side window 5. As an alternative, it is also possible to determine the manual operation of one of the door opening handles 17 and/or 18, e.g., by a sensor and/or a switch situated on the handle 17 and/or 18 to trigger the movement control which is also referred to as short-stroke lifting. To recognize whether the side window 5 is to be raised into the intermediate position ZP, preferably the completely lowered position AP of the side window 5 is first determined. This may be done by means of a limit switch, for example, or a sensor (not shown) which is arranged in the path (double arrow DP), in particular at the corresponding end position of the side window 5. However, it would also be conceivable to use the current movement position of the window lifter 19 and/or the drive motor for the movement control of the window 5.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for controlling movement of a movable side window in a side door of a motor vehicle, said side window being movable by a window lifter, comprising moving the side window automatically via the window lifter into a predetermined intermediate position as a function of a movement of the side door, said intermediate position differing from a completely closed and a completely lowered position of the side window, wherein, starting from the completely lowered position of the side window, the side window is raised into the intermediate position before the side door reaches a closed position so that at least some portion of an upper window edge of the side window is disposed in a sealing gap situated on a railing of the side door, wherein the side window is automatically moved back into the completely lowered position when the side door has again reached its closed position.

2. A method as recited in claim 1, wherein, starting from the completely lowered position of the side window, the side window is automatically raised into the intermediate position when opening the side door.

3. A method as recited in claim 2, wherein, when manual operation of a door opening handle of the side door is sensed, the side window is automatically raised into the intermediate position.

4. A method as recited in claim 1, wherein, when locking of a lock of the side door is sensed, the side window is automatically moved into the completely lowered position.

5. A method as recited in claim 1, further comprising sensing the completely lowered position of the side window.

* * * * *